United States Patent [19]

Shekleton

[11] Patent Number: 5,040,371

[45] Date of Patent: Aug. 20, 1991

[54] FUEL INJECTORS FOR USE WITH COMBUSTORS

[75] Inventor: Jack R. Shekleton, San Diego, Calif.

[73] Assignee: Sundstrand Corporation, Rockford, Ill.

[21] Appl. No.: 519,304

[22] Filed: May 7, 1990

Related U.S. Application Data

[63] Continuation of Ser. No. 283,065, Dec. 12, 1988, abandoned.

[51] Int. Cl.[5] ..... F02C 1/00

[52] U.S. Cl. ..... 60/748

[58] Field of Search ..... 60/748, 737, 743, 740, 60/734; 431/169, 183

[56] References Cited

U.S. PATENT DOCUMENTS

| | | | |
|---|---|---|---|
| 2,654,996 | 10/1953 | Boninsegni . | |
| 3,866,413 | 2/1975 | Sturgess . | |
| 3,886,736 | 6/1975 | Kawaguchi . | |
| 3,946,552 | 3/1976 | Weinstein et al. | 60/743 |
| 3,972,182 | 8/1976 | Salvi | 60/743 |
| 4,194,358 | 3/1980 | Stenger | 60/748 |
| 4,198,815 | 4/1980 | Bobo et al. | 60/748 |
| 4,419,863 | 12/1983 | Dvorak et al. . | |
| 4,598,553 | 7/1986 | Saito et al. . | |
| 4,653,278 | 3/1987 | Vinson et al. . | |
| 4,689,961 | 9/1987 | Stratton . | |

FOREIGN PATENT DOCUMENTS

| | | | |
|---|---|---|---|
| 2085147 | 4/1982 | United Kingdom | 60/748 |

*Primary Examiner*—Louis J. Casaregola
*Assistant Examiner*—Timothy S. Thorpe
*Attorney, Agent, or Firm*—Wood, Phillips, Mason, Recktenwald & Van Santen

[57] ABSTRACT

The high cost of fuel injectors for use in small scale environments is avoided in a fuel injection nozzle structure including a simple tube 10 used as a fuel injecting tube and having a fuel injecting end 12 received in a reduced diameter outlet 18 from an axial air flow chamber 20 concentric therewith. A swirling air flow chamber 34 surrounds the axial air flow chamber 20 and includes an annular, axially facing outlet 36 concentric with a diverging exit 24 from the reduced diameter outlet 18.

7 Claims, 1 Drawing Sheet

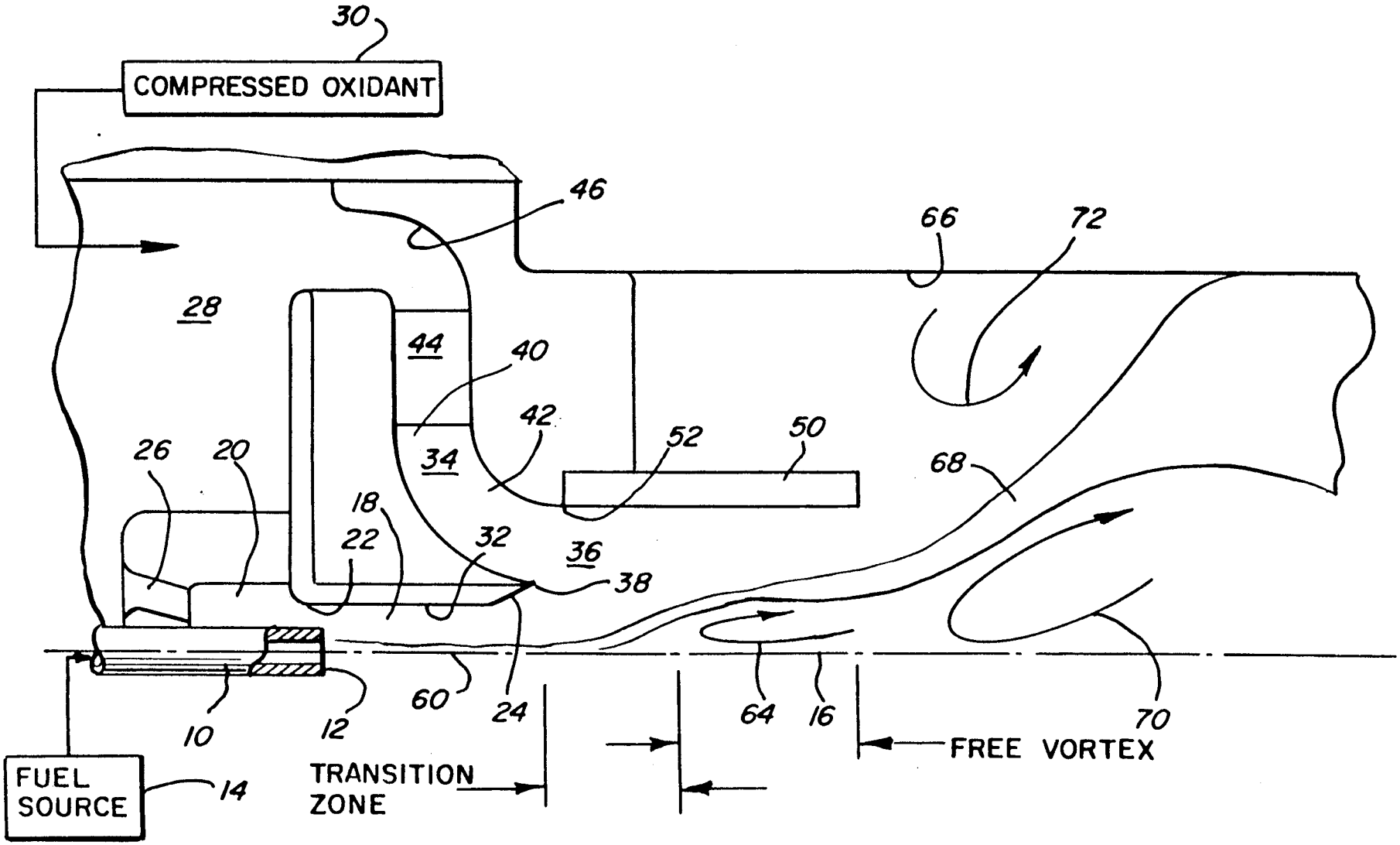
COMPRESSED OXIDANT
30
46
66
72
28
44
40
42
34
50
52
36
38
32
18
22
20
26
68
70
FREE VORTEX
16
64
24
60
12
TRANSITION ZONE
10
14
FUEL SOURCE

FUEL INJECTORS FOR USE WITH COMBUSTORS

This application is a continuation of application Ser. No. 283,065, filed Dec. 12, 1988, now abandoned.

FIELD OF THE INVENTION

This invention relates to fuel injectors, and more particularly, to an inexpensive and simply constructed fuel injector that may be utilized with combustors which in turn may be employed in turbine engines.

BACKGROUND OF THE INVENTION

Swirl flow in combustors has been shown to be advantageous because the high centrifugal forces generated during operation may be utilized to advantageously modify flame turbulence. However, in small scale apparatus, wherein fuel is frequently atomized by high velocity air as a result of the pressure drop across an air swirler, the resulting fuel droplets are rapidly accelerated up to the speed of the air and mixed with the air as a consequence of the extremely high centrifugal forces present. When employed with turbines, at low turbine speeds and at low air temperatures, much of the fuel fails to evaporate and impinges as small droplets on the wall of the combustor. Tough starting of a turbine engine at low rotational speeds is a result.

This difficulty may be alleviated by upsizing the combustor but where the turbine is to be employed in an airborne environment, which is frequently the case and even the cause of low temperature, size and mass problems are compounded.

Moreover, in small scale turbines employing small scale combustors, a low cost apparatus is a commercial necessity. The injectors employed must be downsized and consequently must be simple and inexpensive to form. This in turn frequently means that the size of the fuel droplets generated during atomization by such small injectors increases. The increased droplet size means, of course, greater mass and greater susceptibility to the action of centrifugal force resulting from swirl flow.

Furthermore, even when starting ability is not of primary concern, the premixing of fuel and air as mentioned previously tends to lower stability of the flame and frequently, gaseous phase smoke is produced at fuel rich conditions that are provided to improve flame stability. This in turn results in high flame radiation. The combustor walls necessarily must absorb such radiation and as a consequence, the cooling of the combustor walls becomes more difficult.

The present invention is directed to overcoming one or more of the above problems.

SUMMARY OF THE INVENTION

It is the principal object of the invention to provide a new and improved fuel injector of the type that may be used with a combustor in the environment of, for example, a turbine engine. More particularly, it is an object of the invention to provide such a fuel injector which may be advantageously employed in small scale combustors and yet provides for good low speed starting of a turbine engine associated therewith, includes good flame stability and avoids operation with smokey, luminous flames.

An exemplary embodiment of the invention achieves the foregoing objects in a nozzle structure including a fuel injecting tube adapted to be connected to a source of fuel under pressure and having a fuel injecting end. An axial air flow chamber surrounds the tube in spaced relation and is generally concentric thereto. The chamber has an elongated, reduced diameter outlet about and extending past the tube end and terminating in a diverging section remote from the tube end. A swirling air flow chamber surrounds the axial air flow chamber and has an annular, axially facing outlet concentric with the diverging section and swirling means upstream of the outlet for imparting a swirling motion to air as it moves to the annular outlet.

As a consequence, fuel being injected from the tube is atomized by air from the axial air flow chamber and the resulting stream is maintained on the injector axis by a swirling flow of air from the annular outlet. Since fuel droplets are located essentially on the axis of the device, centrifugal force is not applied thereto. As the fuel moves away from the end of the tube, it encounters recirculating hot burning gas and begins to move somewhat radially outwardly as well as axially as it transitions from a confined stream to a free vortex stream. The recirculating hot gas rapidly evaporates the fuel droplets before swirl sufficient to cause the droplets to centrifuge out to the walls of a combustor in which the injector is used is imparted thereto. As a consequence, the above mentioned problems are eliminated.

In a highly preferred embodiment, an axially elongated sleeve extends axially away from the tube end from the radially outer extremity of the annular outlet.

The invention contemplates that the diverging section and the annular outlet meet in a sharp edge.

According to a highly preferred embodiment, the tube end is located at a point of maximum turbulence in the reduced diameter outlet of the axial air flow chamber.

In a highly preferred embodiment, the swirling air flow chamber includes an annular, radially inwardly directed section containing the swirling means and located just upstream of the outlet.

According to the invention, the fuel injecting tube is a simple tube and the axial air flow chamber is free of swirling devices.

Other objects and advantages will become apparent from the following specification taken in connection with the accompanying drawings.

DESCRIPTION OF THE DRAWING

The FIG. is an enlarged, half section of a fuel injector made according to the invention and is to scale.

DESCRIPTION OF THE PREFERRED EMBODIMENT

An exemplary embodiment of a fuel injection nozzle intended for use with a combustor that may be used, for example, in a turbine engine is illustrated in the FIG. and with reference thereto is seen to include a fuel injection tube 10 having a fuel injection end 12 from which the fuel to be injected exits the tube 10. The opposite end of the tube 10 is adapted to be connected to a source of fuel under pressure shown schematically at 14.

According to the invention, for simplicity and low cost, the tube 10 is a simple tube. That is to say, it is not a precision formed part requiring special care or fabrication although it is expected that the end 12 will be deburred and cut perpendicular to the longitudinal axis 16 of the tube which is also the center line of the injector.

The tube end 12 is in the reduced diameter outlet 18 of an axial flow air chamber 20. The air chamber 20 is concentric about the axis 16 as is the outlet 18. The outlet 18 itself includes a rounded, converging entrance 22 and a frustoconical, diverging exit 24.

A plurality of ports 26 (only one of which is shown) of sufficient size as to minimize pressure drop connect the chamber 20 to a manifold or plenum 28 for compressed oxidant which in turn is connected to a source of compressed oxidant shown schematically at 30. In most cases, the oxidant will be compressed air and frequently, but not always, the source 30 will be the compressor of a turbine engine.

Returning to the chamber 20 and associated outlet 18, it will be seen that the two are free of any means that would impart swirling motion to air or oxidant leaving the outlet 18. That is to say, it is intended that the flow of oxidant through the outlet 18 be essentially purely axial, save for such turbulence as may occur in the stream.

In this regard, the end 12 is located at the point of maximum turbulence of the air stream within the outlet 18. Frequently, this will be just within the converging entrance 22 to the outlet 18 and may be ascertained by progressively moving the tube 10 into the outlet 18 until air flow from the chamber 20 through the outlet 18 begins to be impeded by the reduction in cross sectional area of the flow path.

Between the entrance 22 and the exit 24, the outlet 18 is elongated and includes a generally cylindrical inner surface 32.

Disposed about the diverging end 24 of the outlet 18 is a swirling air flow chamber 34 terminating in an annular outlet 36. The annular outlet 36 and the diverging section 24 merge in a sharp edge 38. This prevents the generation of eddy currents where fluid streams from the outlets 18 and 36 meet.

As can be appreciated from the FIG., the chamber 34 includes an annular, radially directed section 40 connected by a bend 42 to the outlet 36. Swirler vanes 44 are disposed within the radial section 40 and a further bend 46 connects the radial section 40 to the compressed air manifold 28.

The swirler vanes 44 are designed such that while the oxidant exiting through the annular outlet 36 will be moving in the axial direction because the outlet 36 faces axially, it will also be moving circumferentially because of a large degree of swirl imparted thereto by the vanes 44.

Preferably, but not always, an elongated, cylindrical sleeve 50 extends from the radially outer extremity 52 of the outlet 36 oppositely and away from the tube 10.

As seen in the FIG., fuel exits the end 12 of the tube 10 in a stream 60 which is confined by the axial air flowing through the outlet 18. The velocity of the flow of air through the outlet 18 will be greater than the velocity of the fuel which will result in the stream 60 being progressively atomized as it moves away from the end 12 but the confining effect of the outlet 18 will maintain the stream 60 on the axis 16 of the injector.

Even after the stream passes the sharp edge 38 whereat the outlet 18 and the outlet 36 merge, the stream 60 will tend to stay on the center line 16 because the swirling flow of air exiting the outlet 36 serves to confine the stream of air leaving the outlet 18 through the exit 24 which in turn tends to confine fuel flow. However, transition of the flow regimens begins to occur as the axially flowing air exiting the outlet 18 begins to be accelerated in the circumferential direction as a result of contact with the stream exiting the annular outlet 36 such that in the zone marked transition zone, the stream 60, while still close to the axis 16 begins to move radially outwardly. The degree to which such radial outward movement is limited to some extent by the presence of the sleeve 50 even when the fuel is swirling as a free vortex in the region marked free vortex. However, at this location, there is a primary inner recirculation zone indicated by an arrow 64 which will consist of hot gases after ignition has occurred and which will rapidly evaporate the fuel droplets within the stream 60 at that location before they can centrifuge out to the sleeve 50 or even a wall 66 of a combustor.

After the confining effect of the sleeve 50 is passed, the stream 60 becomes a flame zone beginning at 68 and the flame will be a blue flame of low radiation and low smoke content. A secondary inner recirculation zone is shown at 70 and, of course, there will be an outer recirculation zone such as shown at 72.

Where the swirling air flow chamber 34 is of the radial inflow type as illustrated, it has been found that in many instances, the sleeve 50 may be omitted as the fact that the air moving to the outlet 36 is directed radially inwardly tends to maintain it at that location momentarily even without the confining sleeve 50 due to inertial effects. At the same time it should be recognized that a purely axially directed swirling air flow chamber may be used in some instances if desired.

It will be appreciated from the foregoing description that a fuel injector made according to the invention is ideally suited for small scale operations. It is extremely simple in construction and therefore of low cost. It provides an ideal means of assuring full evaporation of fuel in a small scale swirl environment to eliminate problems heretofore encountered.

I claim:

1. A fuel injection nozzle for use with a combustor comprising:

a simple, elongated fuel injecting tube of uniform internal and external diameter adapted to be connected to a source of fuel under pressure and having a fuel injecting end cut perpendicular to the elongated axis of the tube;

an inlet plenum;

an axial air flow chamber surrounding said tube in spaced relation and generally concentric thereto, said chamber having an elongated, reduced diameter outlet about and extending past said tube end and terminating in a diverging section remote from said tube end and at least one inlet port interconnecting said axial air flow chamber to said plenum upstream of said reduced outlet;

a swirling air flow chamber surrounding said axial air flow chamber and having an annular, axially facing outlet concentric with said diverging section sand inlet connected to said plenum; and, swirling means upstream of said outlet for imparting a swirling motion to air as it moves to said annular outlet, said swirling means being downstream of both said inlets and said plenum.

2. The fuel injection nozzle of claim 1 further including an axially elongated, generally cylindrical wall extending axially from the radially outer extremity of said annular outlet oppositely and away from said tube.

3. The fuel injection nozzle of claim 1 wherein said diverging section and said annular outlet meet in a sharp edge means sufficiently sharp to prevent the formation of eddy currents thereat.

4. The fuel injection nozzle of claim 1 including means locating said tube end at a point of maximum turbulence in said reduced diameter outlet, said point of maximum turbulence being substantially at the location whereat progressive movement of said tube into said reduced diameter outlet begins to impede air flow from said axial flow chamber through said reduced diameter outlet due to reduction in the cross sectional area of the reduced diameter outlet flowpath.

5. The fuel injection nozzle of claim 1 wherein said swirling air flow chamber includes an annular, radially inwardly directed section containing said swirling means just upstream of said annular outlet.

6. A fuel injection nozzle for use with a combustor comprising:

a fuel injecting tube of uniform internal and external diameter adapted to be connected to a source of fuel under pressure and having a fuel injecting end, said tube being a simple tube;

an axial air flow chamber free of swirling devices and surrounding said tube in spaced relation and generally concentric thereto, said chamber having an elongated, reduced diameter outlet about and extending past said tube end, said reduced diameter outlet having a converging entrance about said tube and a diverging exit remote from said tube end;

a swirling air flow chamber surrounding said axial air flow chamber and having an annular, axially facing outlet concentric with said diverging section, and swirler vanes upstream of said outlet for imparting a swirling motion to air as it moves to said annular outlet; and, means defining a meeting point between said diverging exit and said annular outlet in the form of an annular edge of sufficient sharpness to prevent the formation of eddy currents thereat.

7. A fuel injection nozzle for use with a combustor comprising:

a fuel injecting tube of uniform internal and external diameter adapted to be connected to a source of fuel under pressure and having a fuel injecting end, said tube being a simple tube;

an axial air flow chamber free of swirling devices and surrounding said tube in spaced relation and generally concentric thereto, said chamber having an elongated, reduced diameter outlet about and extending past said tube end, said reduced diameter outlet having a converging entrance about said tube and a diverging exit remote from said tube end;

a swirling air flow chamber surrounding said axial air flow chamber and having an annular, axially facing outlet concentric with said divering section, and swirler vanes upstream of said outlet for imparting a swirling motion to air as it moves to said annular outlet; and a cylindrical sleeve extending axially away from said tube from the radially outer boundary of said annular outlet, said sleeve being axially and radially outwardly spaced from said diverging exit and confining fuel and air so that a first internal recirculation zone may exist axially downstream of said diverging exit within said sleeve, and a second internal recirculation zone larger than said first zone exists axially downstream of said first zone.

* * * * *